US006041706A

United States Patent [19]

Murray

[11] Patent Number: 6,041,706

[45] Date of Patent: Mar. 28, 2000

[54] COMPLETE RELEASE BLANKET

[75] Inventor: Robert Richard Murray, Madbury, N.H.

[73] Assignee: Heidelberger Druckmaschinen AG, Heidelberg, Germany

[21] Appl. No.: 09/080,073

[22] Filed: May 15, 1998

[51] Int. Cl.[7] ..... B41F 5/16

[52] U.S. Cl. ..... 101/217; 101/185; 101/247; 101/350.1; 101/350.4; 101/351.1

[58] Field of Search ..... 101/349.1, 348, 101/350.1, 350.3, 341, 350.4, 351.1, 185, 247, 184, 216, 217, 375

[56] References Cited

U.S. PATENT DOCUMENTS

| | | | |
|---|---|---|---|
| 4,135,960 | 1/1979 | Shuppert et al. | 156/240 |
| 4,517,221 | 5/1985 | Holl | 427/8 |
| 4,953,461 | 9/1990 | Gaffney et al. | 101/142 |
| 5,186,103 | 2/1993 | Gelinas et al. | 101/181 |
| 5,323,702 | 6/1994 | Vrotacoe et al. | 101/217 |
| 5,351,616 | 10/1994 | Gelinas et al. | 101/218 |
| 5,603,264 | 2/1997 | DeMoore et al. | 101/483 |
| 5,647,279 | 7/1997 | Johner et al. | 101/401.1 |

*Primary Examiner*—John Hilten
*Assistant Examiner*—Dave A. Ghati
*Attorney, Agent, or Firm*—Kenyon & Kenyon

[57] ABSTRACT

A printing press includes an interchangeable plate cylinder, in which the plate cylinder may have variable cutoff diameters. The plate cylinder is mounted in the printing press in rolling contact with a fixed diameter blanket cylinder. The ink rollers of the inker mechanism may be positionally adjusted to accommodate a plate cylinder of various diameters. The surface of the printing blanket which is mounted on the blanket cylinder includes a material of low polarity surface energy, such as PTFE. The ink used in the press is selected such that, in combination with the PTFE of the blanket surface, the ink does not remain as a latent image on the blanket cylinder after transfer of the image from the blanket cylinder to a web of material.

16 Claims, 9 Drawing Sheets

Fig. 5a-c

COMPLETE RELEASE BLANKET

BACKGROUND OF THE INVENTION

1. Field of the Invention

The present invention relates to the field of rotary printing presses, and more particularly to variable cutoff printing in rotary printing presses.

2. Description of the Prior Art

Lithographic offset printing is typically done on a continuous process machine in which a web of material, or printing substrate, is fed through various stages of processing in a sequential order to result in the finished, printed product. The web is typically taken from an infeed roll at the beginning of the process and then passes through, for example, several print units, a dryer, a chill unit, a former section, a folder section, an angle bar section, a slitter and a cutting blade. The web is printed upon, cut, folded, and stacked en route to its final product stage.

The printing unit of a lithographic offset press typically contains an inking unit or ink rollers which supply ink to a printing plate, which printing plate is mounted on a plate cylinder. The printing plate contains the image to be printed. The ink is transferred from the printing plate to a printing blanket (i.e., the "plate-to-blanket" transfer), which printing blanket is mounted on a blanket cylinder. The printing blanket in turn transfers the ink onto the web of material (i.e., the "blanket-to-web" transfer). The plate and blanket cylinders have substantially parallel axes and are typically driven such that the surface speed of the plate coincides with the surface speed of the blanket to the degree necessary to achieve acceptable transfer of ink from the plate to the blanket.

Typically, the ratio of the diameters of the plate cylinder (i.e., the plate cylinder with the printing plate mounted upon it) and the blanket cylinder (i.e., blanket cylinder with the the printing blanket mounted upon it) is an integer number, providing such ratios as 1:1, 1:2, etc. One reason that an integer relationship between the plate and blanket cylinder diameters is used is so that the image from the plate is transferred to the same location on the blanket on successive rotations of the cylinders.

Latent images on the blanket cylinder are inked images that remain on the printing blanket after the blanket-to-web transfer due to incomplete transfer of a portion of the ink. Latent images create a need to have the same area on the printing blanket contact the same area on the printing plate on successive rotations. Thus, the plate transfers ink to the same area on the blanket on each revolution. In that manner, the adverse effects of latent images are minimized. However, if the diameters of the plate and blanket cylinders are not matched by a ratio of integers, then the printing plate will transfer an inked image onto a different area on the printing blanket on successive revolutions. Thus, the blanket may transfer to the web of material the primary image (i.e., the image from the most recent plate-to-blanket transfer) as well as a latent image (i.e., an image from a previous plate-to-blanket transfer which was not fully transferred to the web during the prior blanket-to-web transfer).

Because of the problem of doubling or printing a primary image on one location of the web and a latent image at a different location, it has historically been necessary to match the ratios of diameters of the plate cylinder and the blanket cylinder by an integer relationship so that latent images do not show up on the web of material. As a result, variable cutoff printing, or printing in which the image length, and hence the plate diameter, is changed from one print job to another is complicated by the need to match the blanket cylinder diameter to the plate cylinder diameter by an integer relationship.

The need to match the plate and blanket cylinder tangential and angular speeds in order to achieve acceptable print quality is well known in the art of offset printing. Further, a perfect match of the rotational position of the plate cylinder and blanket cylinder is required to insure that any latent image left on the blanket will be exactly refreshed by the plate image on subsequent revolutions.

SUMMARY OF THE INVENTION

If there is no latent image on the blanket cylinder, then there is no need to match the plate and blanket cylinder angular speeds. While other reasons may remain for matching the angular speeds of the plate and blanket cylinders, the need to match the angular speeds to prevent doubling caused by printing of a latent image is removed if there is no latent image. The present invention alleviates the need to match the plate and blanket cylinder diameters by an integer relationship. Hence, the plate cylinder diameter may be continuously variable relative to the blanket cylinder diameter.

It is an object of the present invention to provide a printing press which includes an interchangeable variable cutoff plate cylinder, an adjustable inker mechanism which adapts to accommodate plate cylinders of varying diameter, and a complete release blanket disposed in rolling contact with the interchangeable variable cutoff plate cylinder, adapted to receive an inked image from the plate cylinder and transfer substantially the entire image to a web of material upon which the image is to be printed. A variable cutoff folder would be used in conjunction with the present invention to actually make the cutoff of the printed signatures.

The present invention provides a printing press which includes the use of a blanket having a blanket surface that, in combination with the selected ink, substantially transfers the entire ink volume from the blanket to the web of material. In the present invention, there is no latent image left on the blanket after it contacts the printed substrate or web. This feature is accomplished by coating or impregnating a surface of the blanket with a suitable material of low polarity surface energy—i.e., less than 4 dynes/cm, to create a total surface energy of less than 14 dynes/cm—such as, for example, polytetraflouroethylene ("PTFE"), sold under the trade name Teflon®, or silicone, and using an appropriate water-based ink. Therefore, a new inked image from the plate may be deposited onto the blanket surface at an entirely different position from prior images, without concern for latent images that may cause doubling of the printed image.

An advantage of the present invention is that plates of variable cutoff (i.e., plates with different diameters and thus different image lengths) may be used on a press with adjustable inkers and optimized complete release blankets. The ratio of the diameters of the plate and blanket cylinders does not have to be an integer number. The diameter of the plate cylinder may be, for example, any multiple, including fractional multiples, of the diameter of the blanket cylinder.

According to the present invention, a printing press may be designed such that the blanket cylinder dimensions are optimized for factors such as blanket life, bearing rotational speed, cooling, and internal apparatus—such as shafts and gears. In a offset printing press, the gears and shafts used with the printing and blanket cylinders have a degree of flexibility which is in part dependent upon the size of the cylinder. As a result, in the present invention, the sizes of these components may be optimized for flexibility/rigidity, instead of being constrained by the need for a proper ratio between cylinders. In addition, in the present invention the diameter of the blanket cylinder need not be carefully controlled to accommodate the blanket thickness so as to achieve a proper diameter ratio with the plate cylinder.

The inker form rollers may be chosen, for example, for optimum ink transfer at specific running speeds. The inker form rollers may also be chosen for geometric considerations and needs such as integrating the inker rollers into the inker mechanism and for integrating the inker mechanism into the printing apparatus as a whole. The inker mechanism may be movable with respect to the printing apparatus, for example, with respect to the plate cylinder, such that various sized plate cylinders may be accommodated by the single adjustable inker mechanism.

Another advantage of the present invention is that a printing press may include a plate cylinder having a "gearless" drive, such that, for example, the plate cylinder may be driven entirely through friction contact with, for example, the driven inker rollers or the driven blanket cylinder. Alternatively, the press may include a driven plate cylinder which in turn drives, via a friction contact, the blanket cylinder, which may also be partially driven by the friction contact with a driven web of material that contacts the blanket. A combination of these drive methods may also be employed with perfecting capability, i.e., printing on two sides of a web of material simultaneously.

In a print unit that prints on both sides of a web simultaneously, the top plate cylinder could be motor driven and impart friction to drive the top blanket cylinder, while the bottom plate cylinder could by friction driven by the bottom blanket cylinder. Other variations are possible according to the present invention, wherein the plate cylinder, blanket cylinder, and/or web is driven, and drives one or more of the other cylinders.

BRIEF DESCRIPTION OF THE FIGURES

The foregoing and other features of the present invention will become apparent to those skilled in the art upon reading the following description of preferred embodiments of the invention in view of the accompanying drawings, wherein.

DETAILED DESCRIPTION OF THE INVENTION

Figure 1A:
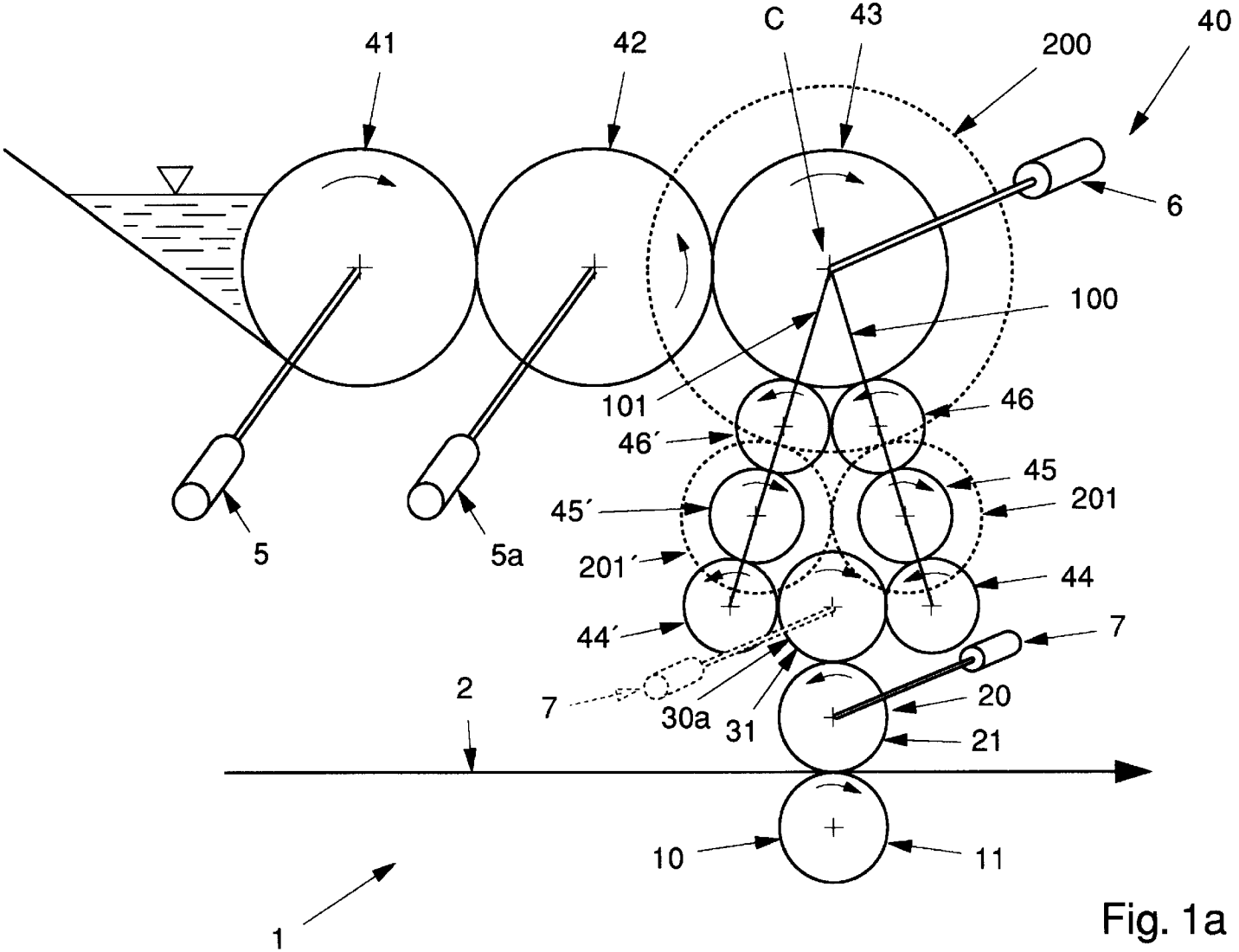
FIG. 1*a* shows a side, partially schematic, view of an exemplary offset printing blanket cylinder, plate cylinder and ink rollers according to a first embodiment of the present invention.
Figure 1B:
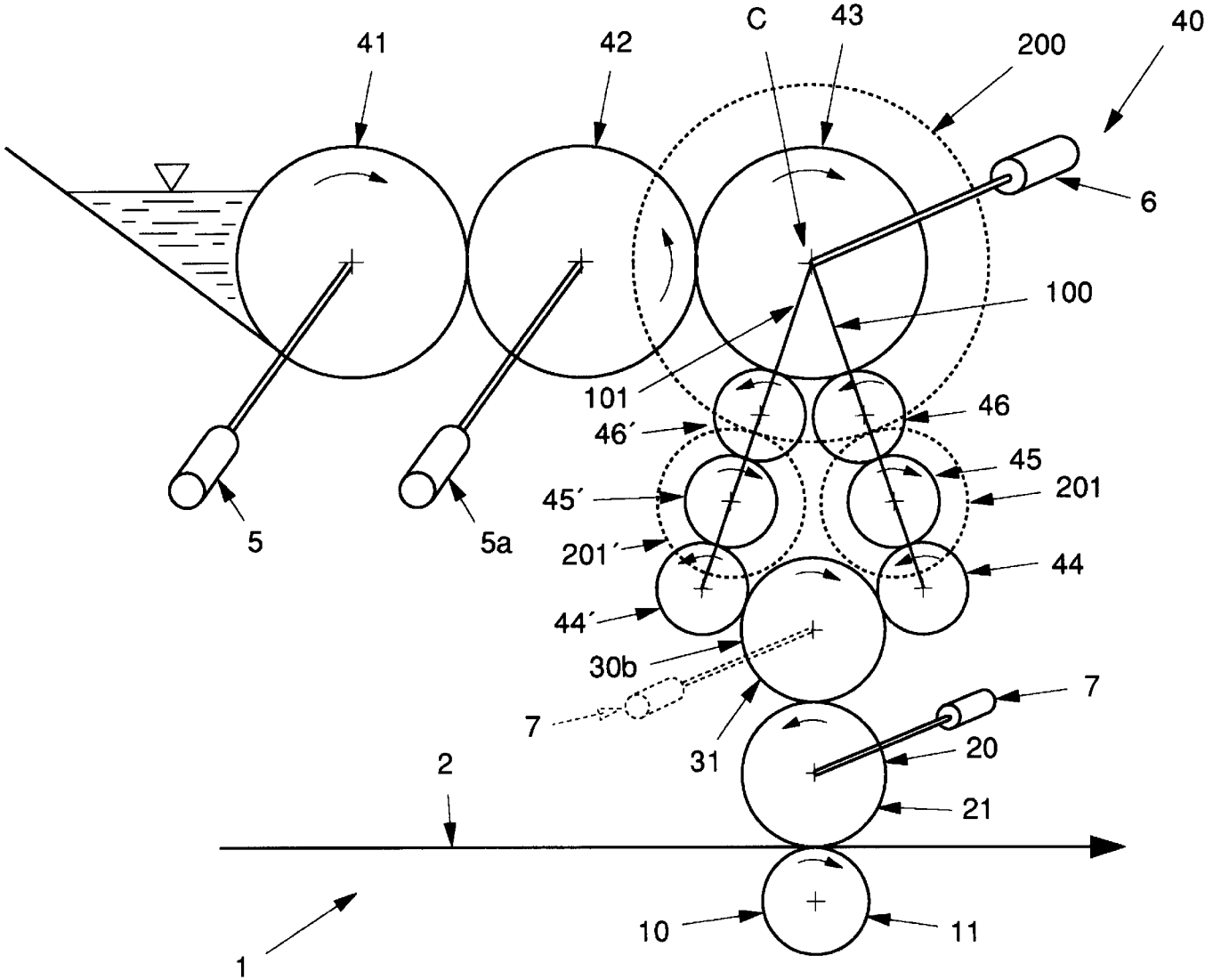
FIG. 1*b* shows the embodiment of FIG. 1*a*, with a larger-sized plate cylinder.
Figure 1C:
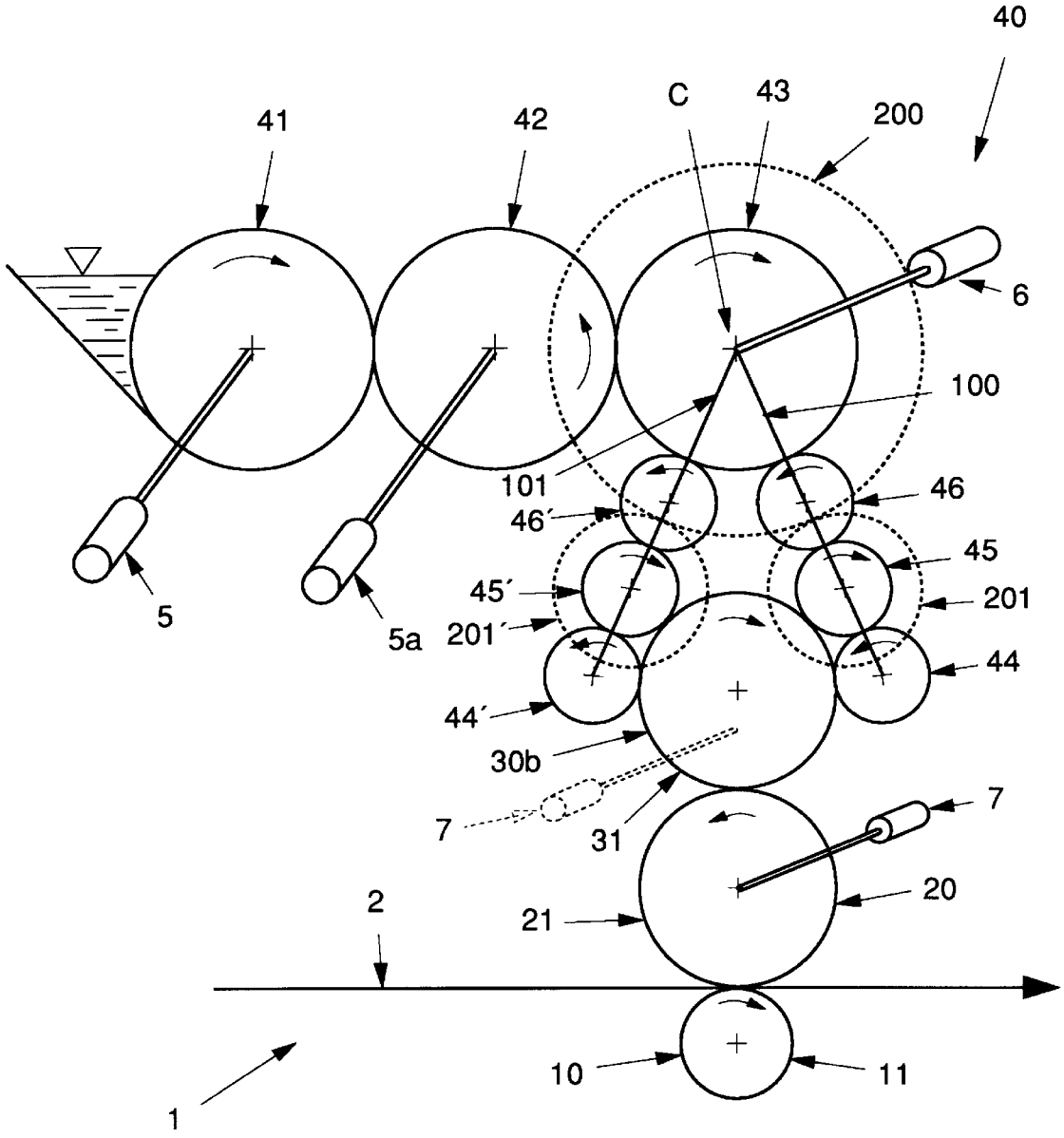
FIG. 1*c* shows the embodiment of FIG. 1*a*, with a larger-sized plate cylinder.

FIGS. 1*a*–1*c* show side, partially schematic, views of a section of a printing unit 1 which includes a bottom blanket cylinder 10 and a top blanket cylinder 20. The blanket cylinders 10, 20 are rotatably mounted in a frame or frames of the printing unit 1 and form a nip through which a web of material 2 may pass. A top plate cylinder 30*a*, 30*b* or 30*c* is rotatably mounted adjacent to the top blanket cylinder 20, and the plate cylinder 30*a*, 30*b* or 30*c* has a printing plate mounted upon it. Adjacent to the top plate cylinder 30*a*, 30*b* or 30*c* is the inker mechanism designated generally by reference numeral 40. The inker mechanism or ink train 40 includes, for example, rotatably mounted form rollers 44,44', vibrator rollers 45,45', distribution rollers 46,46', a primary roller 43, and a metering roller 42. The metering roller 42 is adjacent to and receives ink from the ink fountain roller 41.

In operation, tubular printing blankets 11, 21 (not shown in detail) are mounted on the top and bottom blanket cylinders 10, 20 respectively. In addition, a bottom plate cylinder (not shown) and bottom inker mechanism (not shown) would be associated with bottom blanket cylinder 10. The bottom cylinder 10 could be just an impression cylinder if no printing is required on the second or bottom side of the web 2 (i.e., for non-perfecting printing). Unless otherwise specified, reference to a blanket cylinder refers to a blanket cylinder with a printing blanket mounted upon it. Similarly, unless otherwise specified, reference to a plate cylinder refers to a plate cylinder with a printing plate (either flat or tubular) mounted upon it, or a cylinder which has an image material applied to its outer surface.

The printing unit 1 also includes, for example, four drive motors 5, 5*a*, 6, 7. The first motor 5 drives the ink fountain 41. The second motor 5*a* drives the metering roller 42. The third motor 6 drives the ink train 40, via primary roller 43. The fourth motor 7 drives the blanket cylinder 20. Alternatively, the fourth motor 7 may drive the plate cylinder (shown in dashed lines in FIGS. 1*a*–1*c*, 2–4 and 7). The metering roller 42 preferably matches the speed of the primary roller 43; if any mismatch is neglected, the second motor 5*a* is not required. The fountain roller 41 runs at a lower speed, in order to ensure that a large volume of ink is spread along its surface without using significant power and without slinging ink. As a result, in order for metering roller 20 to match the press speed, it must be driven apart from fountain roller 41, either via motor 5*a* or via driven primary roller 43. Gearing 200 may be provided on the primary roller 43, which mates with gearing 201, 201' on vibrator rollers 45, 45', to thereby drive vibrator rollers 45, 45'. Preferably, the form rollers 44, 44' and the distribution rollers 46, 46' are friction-driven, via contact with the primary roller 43 and vibrator rollers 45, 45', respectively. The print cylinder 30*a*, 30*b* or 30*c* may be friction-driven, via contact with the blanket cylinder 20 (if blanket cylinder 20 is driven by motor 7) or form rollers 44,44', or the blanket cylinder 20 may be friction-driven, via contact with the print cylinder 30*a*, 30*b* or 30*c* (if print cylinder 30*a*, 30*b* or 30*c* is driven by motor 7). Alternatively, gears may be provided between print cylinder 30*a*, 30*b* or 30*c* and blanket cylinder 20 for driving either.

In two-sided printing, that is, when images are printed on both sides of the web 2 as it passes between two printing blankets 10, 20, the ink train 40 and cylinder drive arrangement 5, 6, 7 may be repeated for the lower half of the press (not shown). Alternatively, for one sided printing, the bottom blanket cylinder 10 may be replaced by an impression cylinder.

The ink fountain roller 41 is rotated at a speed which delivers a constant film of ink to the metering roller 42, via a small gap, as is standard, for example, in the Heidelberg Web Press model M-3000™ and other web offset printing presses. The surface speed of the metering roller 42 is controlled to match the press speed (i.e., the surface speed of the plate cylinder) via, for example, gearing or a drive motor 5*a* using a feedback speed and position matching system known in the art. The press speed, that is, the same surface speed, is maintained through the ink train 40, by matching gear ratios and roller diameters. Heavy dampening resulting, for example, from the rubber covering on the form rollers 44, 44' and primary roller 43 and the viscosity of the ink cause the system of rollers to heat up and rotate without rotational oscillation. The heat may be partially removed by circulating a coolant such as water through the rollers. Some heat may also be transferred to the air and to the ink and then to the web 2.

The ink train 40 may be adapted to pivot about the primary roller 43, which is located, for example, after the metering roller 42. The ink train 40 may have two portions, one to the right of the primary roller 43 including rollers 44, 45 and 46, and one to the left including rollers 44', 45' and 46'. The right and left portions may, for example, be hinged about the primary roller 43, by being mounted on arms 100, 101 (shown schematically in FIGS. 1*a*–1*c*), respectively, which are mounted for pivoting about the center C of primary roller 43. This hinged arrangement allows the form rollers 44, 44' and all of the associated distribution rollers 46, 46' and vibrator rollers 45, 45' of the ink train 40 to spread or contract together in order to accommodate any variable diameter plate cylinder 30*a*, 30*b* or 30*c*. This can be seen in particular in comparing FIGS. 1*a*, 1*b*, and 1*c*, where FIG. 1*a* shows a position of the arms 100, 101 when the smallest plate cylinder 30*a* is used (such that the distribution rollers 46, 46' are almost touching one another and the form rollers 44, 44' contact the plate cylinder 30*a*180 degrees apart). FIG. 1*b* shows an intermediate-sized plate cylinder 30*b*. FIG. 1*c* shows a position of the arms 100, 101 when the largest plate cylinder 30*c* is used (such that the vibrator rollers 45, 45' are almost touching the print cylinder 30*c*). In each configuration, the ink train connects the metering roller 42 to the plate cylinder 30*a*, 30*b* or 30*c*, no matter what size of plate cylinder 30*a*, 30*b* or 30*c* is being used, within geometric restrictions, and the ink train 40 is properly driven at an appropriate speed to provide ink to ink an image for transfer to blanket cylinder 20.

Figure 2:
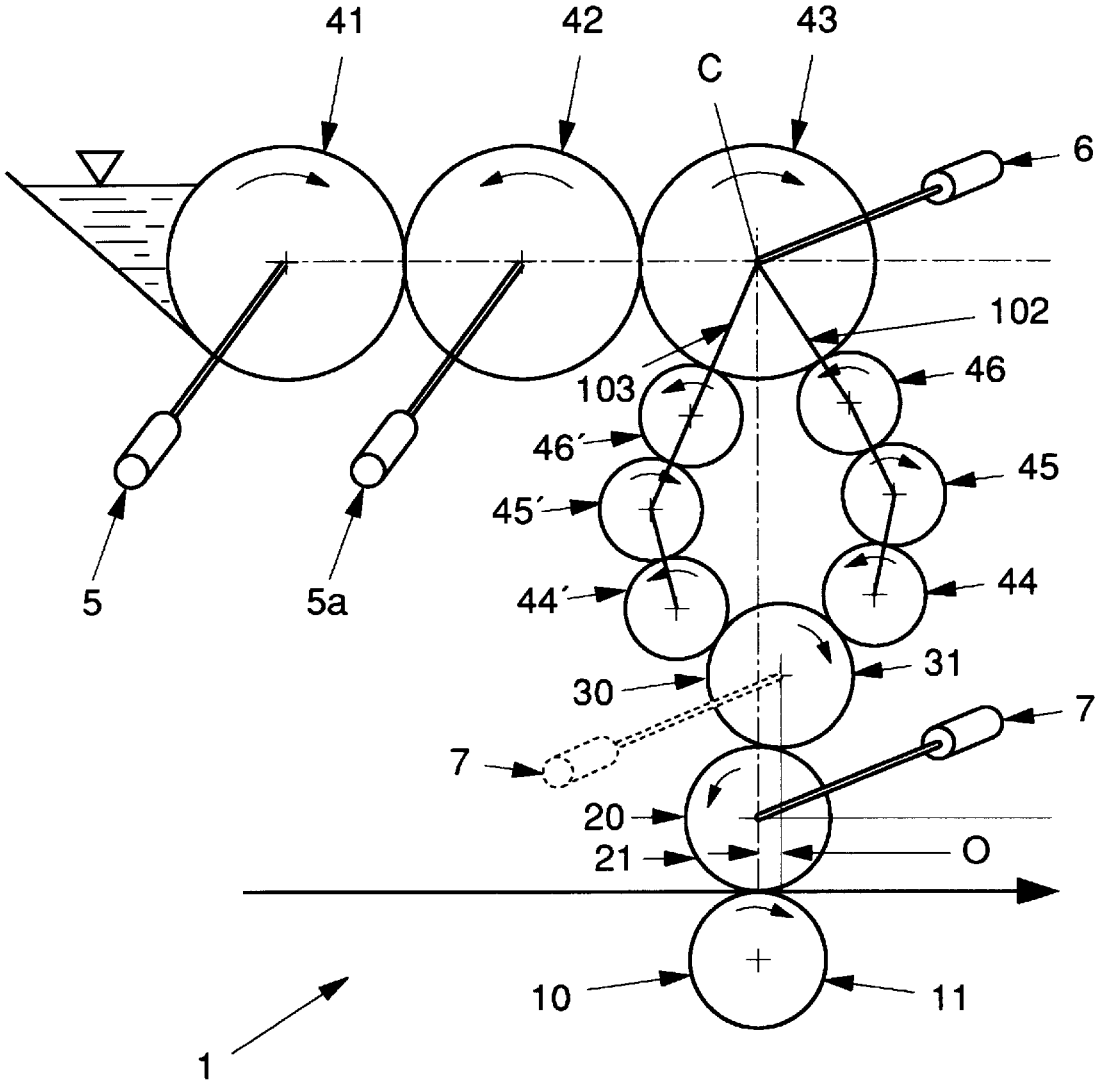
FIG. 2 shows a side view of an exemplary offset printing blanket cylinder, plate cylinder and ink rollers according to a second embodiment of the present invention.
Figure 3:
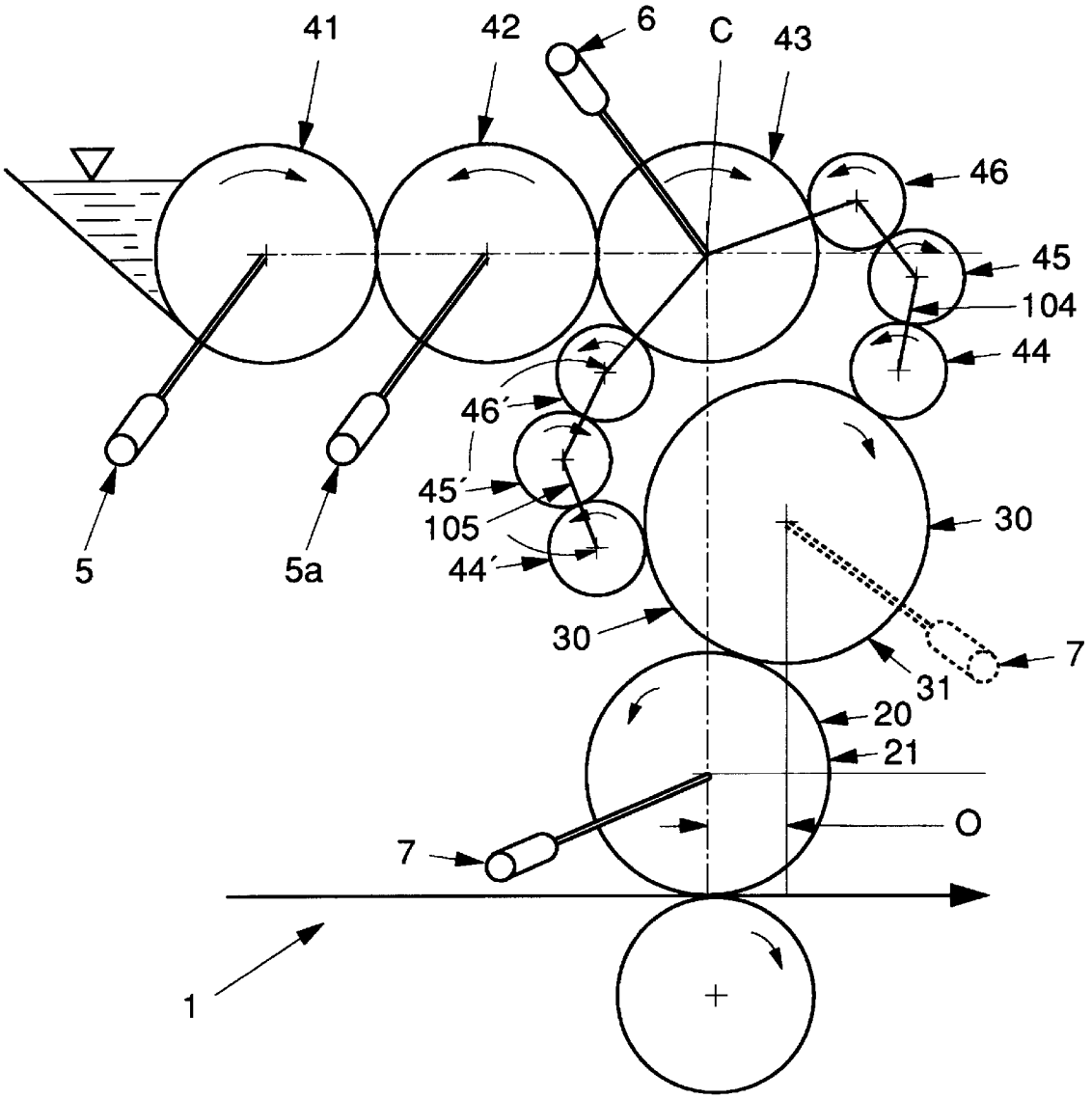
FIG. 3 shows a side view of an exemplary offset printing blanket cylinder, plate cylinder and ink rollers according to a third embodiment of the present invention.
Figure 4:
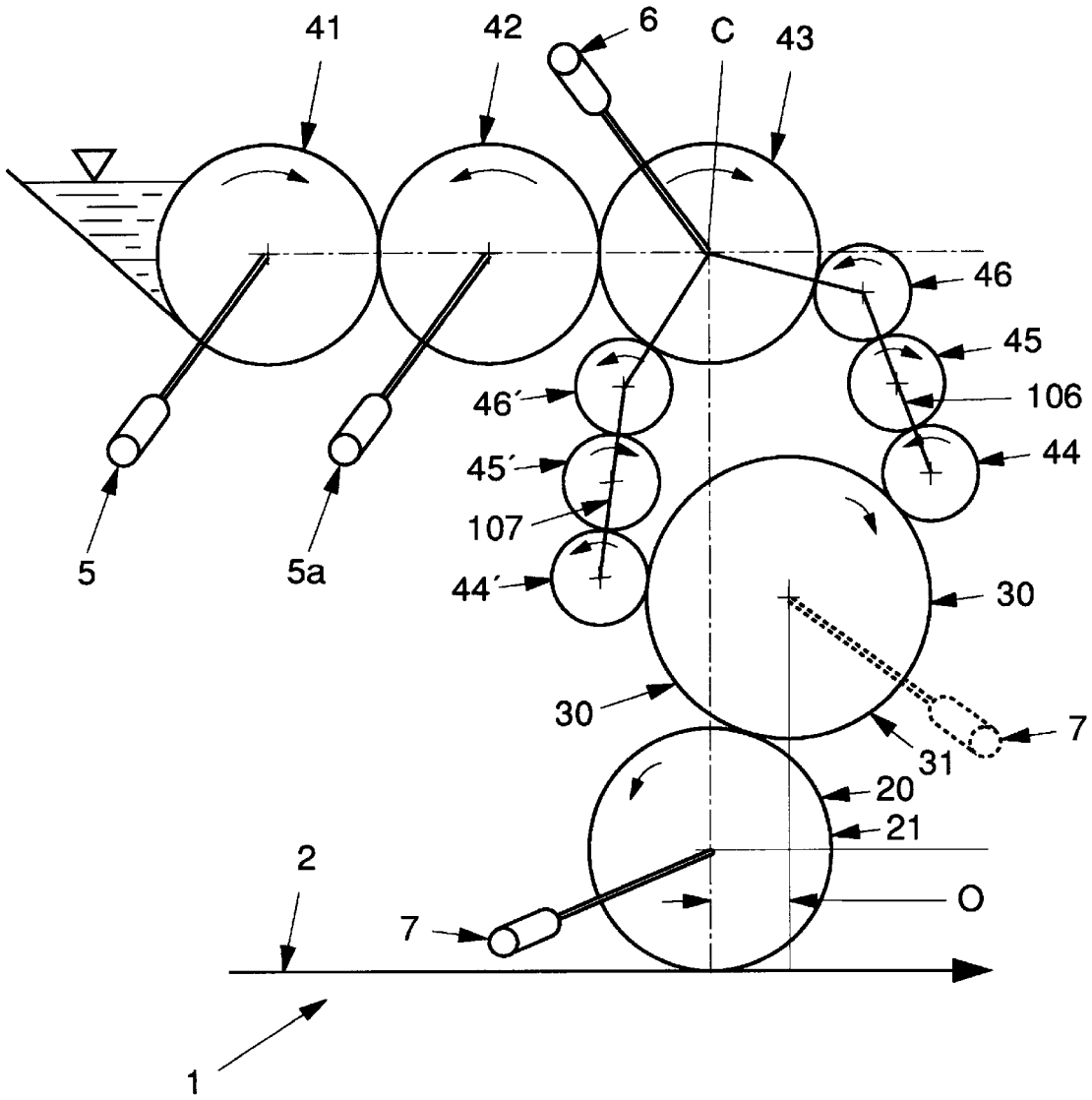
FIG. 4 shows a side view of an exemplary offset printing blanket cylinder, plate cylinder and ink rollers according to a fourth embodiment of the present invention.

The rollers of the ink train 40 do not have to be "in-line," that is, they do not have to be arranged such that a straight line will connect the axis of rotation of each roller. FIGS. 2 and 3 show embodiments where the rollers of the ink train 40 are not "in-line." This is accomplished by using arms 102, 103 or 104, 105 which are not straight. These configurations may be advantageous in allowing the printing unit 1 to accommodate larger plate cylinder 30 sizes than the embodiment of FIGS. 1*a*–1*c*. Another potentially advantageous arrangement, shown in the embodiments of FIGS. 2–4, is to configure the shape and position of the arms 102, 103 or 104, 105 or 106, 107, so that the plate cylinder 30 may have an axis which is offset from the axis of the blanket cylinder 20 by an offset amount O. This configuration may also be used to accommodate larger size print cylinders 30.

As the geometry and relationship of the ink train rollers 40 are not tied to any specific arrangement, such as linear, or roller diameters, any appropriately fitting geometry may be used, and are not limited to those shown in FIGS. 1*a*–1*c* and 2–4. It is to be understood that the arms 100, 101 or 102, 103 or 104, 105 or 106, 107 may accommodate any appropriate number of rollers necessary to provide effective transfer of ink to plate cylinder 30. It is also to be understood that the gearing 200, 201, 201' has been omitted from FIGS. 2–4 for clarity.

Figures 5A, 5B, 5C:
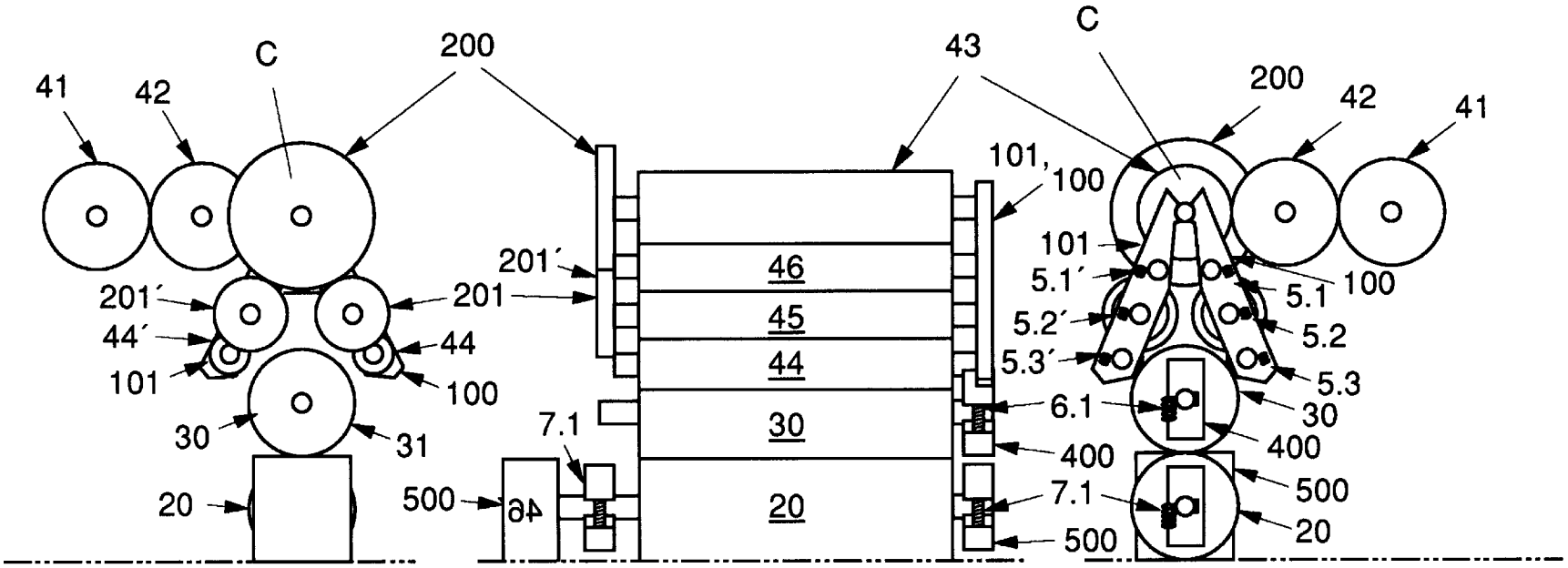
FIGS. 5*a*, 5*b* and 5*c* show side elevation, front elevation and rear elevation views of the embodiment of FIGS. 1*a*–1*c*.

In addition to the rollers of the ink train 40 being adjustable about the primary roller 43, each of the rollers 44, 44', 45, 45', 46, 46' may be adjustably mounted so as to ensure proper contact and force between the rollers for appropriate ink transfer. This may be accomplished by appropriate pressure regulating devices 5.1, 5.1', 5.2, 5.2', 5.3, 5.3' (see FIG. 5*b*) as well as an adjustable mounting of the shaft of rollers 44, 44', 45, 45', 46, 46' on arms 100, 101 or 102, 103 or 104, 105 or 106, 107. The shafts of these rollers may be mounted for some lateral movement relative to arms 100, 101 or 102, 103 or 104, 105 or 106, 107, and pressure regulating devices 5.1, 5.1', 5.2, 5.2', 5.3, 5.3' control this movement and provide a force to press the rollers against one another. Pressure regulating devices 5.1, 5.1', 5.2, 5.2', 5.3, 5.3' may be in the form of springs (as shown in FIG. 5*b*), or may be in the form of any other known device for providing movement and a force, such as, e.g., a pressure cylinder. This extra degree of freedom may provide adjustment capability to the inker mechanism in order to allow proper circumferential surface interaction between the form rollers 44, 44' and the plate cylinder 30, between the vibrator rollers 45, 45' and both the form rollers 44, 44' and the distribution rollers 46, 46', and between the distribution rollers 46, 46' and both the vibrator rollers 45, 45' and the primary roller 43. The form rollers 44, 44' may thus be positioned adjacent to the plate cylinder 30 in order to provide ink to the plate cylinder 30 as the form rollers 44, 44' rotate into contact with the plate cylinder 30. Using the adjustable components described, it is thus possible to have an interchangeable plate cylinder 30 in a print unit 1 between the ink fountain roller 41 and the web 2.

As will be understood, the plate cylinder 30 is interchangeably mounted, in a frame 400, so that plate cylinders 30*a*, 30*b*, 30*c*, etc. of various sizes may be used. A pressure regulating device 6.1, similar to the pressure regulating devices 5.1, 5.1', 5.2, 5.2', 5.3, 5.3', may be used to adjust the position of the plate cylinder shaft relative to the blanket cylinder 20 (so as to accommodate for various sizes of the plate cylinder 30), as well as to provide an appropriate amount of pressure between plate cylinder 30 and both blanket cylinder 20 and form rollers 44, 44'. It is to be understood that frame 400 is designed with a bearing for the shaft of print cylinder 30 which may be moved toward and away from blanket cylinder 20 depending on the size of the print cylinder. The blanket cylinder 20 may also be interchangeably mounted, in a frame 500, so that blanket cylinders 20 of various sizes may be used. A pressure regulating device 7.1, similar to the pressure regulating devices 5.1, 5.1', 5.2, 5.2', 5.3, 5.3', 6.1 may be used to adjust the position of the blanket cylinder shaft relative to the web 2 (so as to accommodate for various sizes of the blanket cylinder 20), as well as to provide an appropriate amount of pressure between blanket cylinder 20 plate cylinder 30 and plate cylinder 30. It is to be understood that frame 500 may be designed with a bearing for the shaft of blanket cylinder 20 which may be moved toward and away from web 2 depending on the size of the blanket cylinder.

The printing blanket 21 preferably has a continuous blanket surface such that there are no gaps or "non-print" areas on the surface of the blanket 21. For example, a sleeve-type blanket has a seamless print surface formed by placing a continuous seamless printing rubber around a tubular base constructed of, for example, plastic or metal. Tubular sleeve-type printing blankets are typically installed by sliding them longitudinally onto the blanket cylinder 20. Sleeve-type blankets do not have longitudinal gaps as do conventional flat printing blankets, and thus, ink may be transferred to and from the printing blanket 21 over its entire 360° cylindrical periphery. Flat printing blankets, on the other hand, are wrapped around the blanket cylinder and the ends of the blanket are secured in a longitudinal gap extending across the blanket cylinder. The gap creates a non-print area on the blanket surface, which is undesirable in the present invention as the non-print area may coincide with a printed area on the plate cylinder 30.

According to the present invention, the blanket cylinder 20 may have a fixed size and have its surface speed (i.e. the surface speed of the printing blanket 21 mounted on the blanket cylinder 20 ) matched to the average surface speed of the form rollers 44, 44'. Thus, the blanket cylinder 20 may have a diameter optimized for such factors as bearing rotational speed, blanket life, heat transfer and cooling characteristics, dynamic stability or other factors. The diameter of the blanket cylinder 20 does not have to be an integer multiple of the diameter of the plate cylinder 30. Also, the blanket cylinder 20 does not need to be replaced when plate cylinders 30 having variable cut-offs (i.e., varying diameters) are installed into the printing unit 1. The surface speeds of the plate cylinder 30 and blanket cylinder 20, however, must be matched to prevent smearing or circumferential slurring of the image when ink is transferred from the plate cylinder 30 to the blanket cylinder 20. If the surface speeds are not matched, the blanket 21 will scrub across the plate 31 at the nip between the blanket cylinder 20 and plate cylinder 30.

Figure 7:
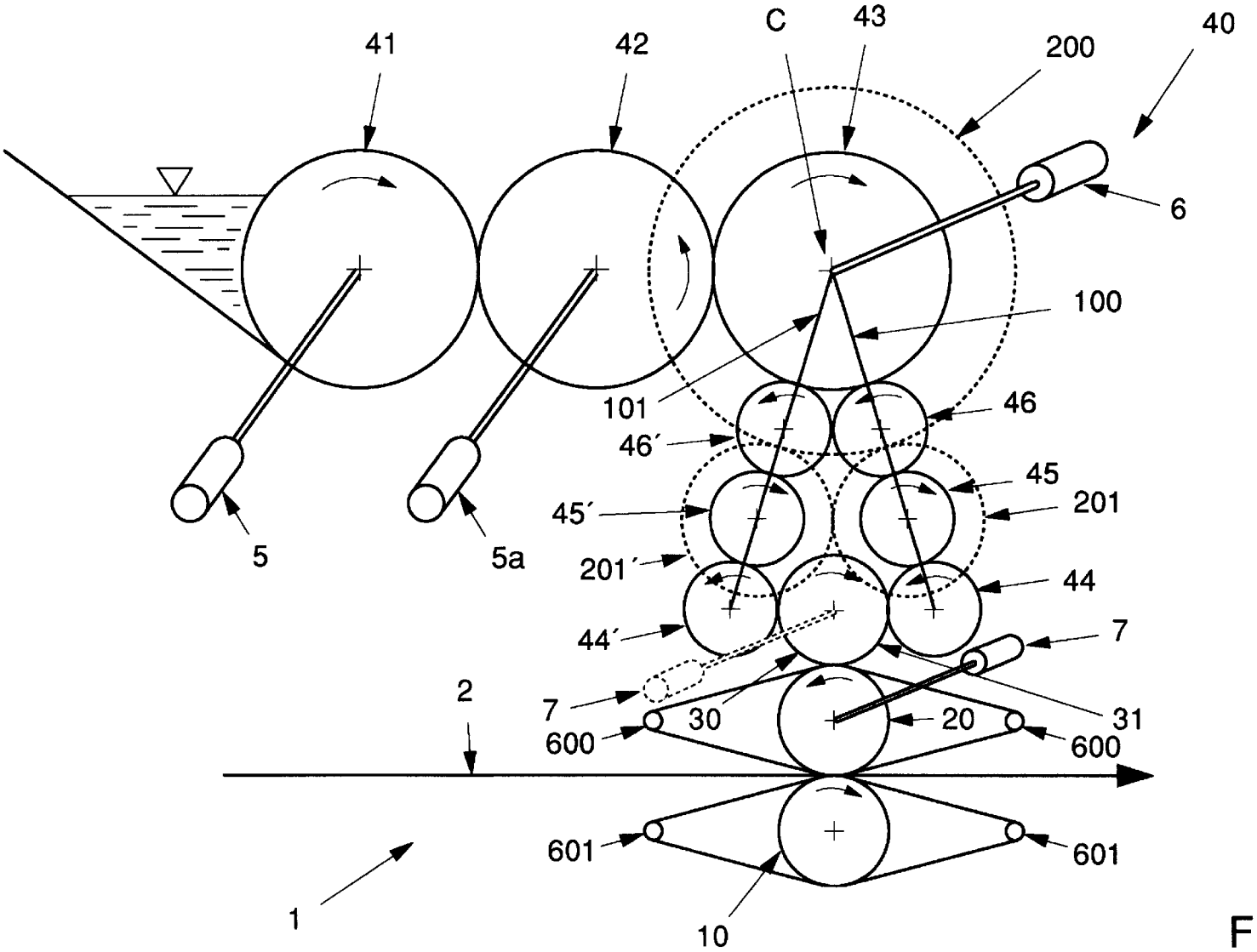
FIG. 7 shows a side view of an exemplary offset printing blanket cylinder, plate cylinder and ink rollers according to a fifth embodiment of the present invention.

There are several ways to insure that the plate cylinder 30 and blanket cylinder 20 have surface speeds that match. The blanket 21 can, for example, be a loose sleeve with, for example, a friction coupling to the plate cylinder 30. Alternatively, the blanket cylinder 20 may have tooth strips on its edges which match similar tooth patterns on the exterior of the plate cylinder 30. This problem and solution is not any different than assuming no slip to the web 2 at all driven nips. The slip of the blanket 21 to its driven roller or cylinder is so small that it can be neglected. This even allows the concept of belted blankets. A belted blanket arrangement is shown in FIG. 7. Instead of a tubular blanket, like that shown in FIGS. 1*a*–1*c* and 2–4, in FIG. 7 belted blankets 611, 621 are entrained over the blanket cylinders 10, 20, respectively, and are also entrained over idler rollers 601, 600, respectively. The belted blankets 611, 621 travel around the blanket cylinders and the idler rollers, but otherwise transfer the image from the plate cylinder 30 to the web 2 in the same manner as the blankets described above. Such belted blankets are known in the art for certain types of printing.

According to the present invention, a variable cutoff printing unit 1 is designed such that only the plate cylinder 30 needs to be changed to change image size while the blanket cylinder 20 may remain in the print unit. The plate cylinder 30, of whatever size is chosen, is always positioned so that its circumference is in rolling contact with the blanket cylinder 20, as a result of, e.g., a slot with a bearing housing located in the frame 400, allowing adjustment of the shaft of the plate cylinder 30 relative to the blanket cylinder 20, depending on the size of the plate cylinder 30. Another manner of changing the size of the print cylinder 30 would entail not changing the print cylinder itself, but instead would involve placing saddles or sleeves of various thicknesses over the plate cylinder 30, thereby resulting in different diameters of the plate cylinder. An apparatus and method for changing plate cylinder diameter in this manner is disclosed in U.S. patent application Ser. No. 08/577,642, incorporated herein by reference. The inker mechanism 40, as discussed above, adjusts so that the form rollers 44, 44' are positioned to transfer ink to the circumferential surface of the print cylinder 30, no matter what its size. Thus, an adjustable cutoff printing unit 1 is achieved according to the present invention.

As applicable to the embodiments of the invention, for double sided printing, the bottom half (not shown) of the print unit 1 may be symmetrical about the web 2 passing through the print unit 1. In such a case, the surface speed of the bottom blanket cylinder 10 may be matched with the surface speed of the top blanket cylinder 20 in order to achieve proper print quality on both sides of the web 2. The rotational speed of the blanket cylinder 20 is also synchronized with the ink form rollers 44, 44' so that the surface speeds of the blanket cylinder 20 and form rollers 44, 44' are substantially equal. The form rollers 44, 44' are also synchronized with the speed of the ink rollers 45, 45' so that their surface speeds are substantially equal.

The rotational position of the bottom plate cylinder (not shown) may be synchronized with the rotational position of the top plate cylinder 30, for example, by controlling the speed of the blanket cylinders 10, 20 or plate cylinders 30. Thereby, it may be ensured that the front and back (i.e., top and bottom) images printed upon the web 2 are matched in position.

The correct phasing of the plate cylinder 30 may be maintained by varying the pressure of the drive of the plate cylinder, by adjusting one or more of the pressure regulating elements 5.3, 5.3', 6.1 or 7.1. A decrease in pressure will allow the plate cylinder 30 to slow down and move to the proper phase or register position, thereby allowing register adjustment. The speed of the ink train 40 is maintained so that a constant volume of ink is delivered for each revolution of the plate cylinder 30. For color printing, a printing press typically has multiple print units, each print unit printing, for example, with a different color ink. To insure proper color registration from print unit to print unit (i.e. to insure that the image coincides from print unit to print unit), the position and rotational speed of the plate cylinders 30 of the various print units must be synchronized.

During periods of severe misregister, such as during startup, the ink train 40 may be used to advance the plate cylinder 30 relative to the blanket cylinder 20 and the web 2, in the manner described above for adjusting register of the plate cylinder 30. This is done in order to bring images on the web into registration, from printing unit to printing unit.

In certain circumstances, it may be advantageous to slightly speed up or slow down the blanket cylinder 20 in order to fit a printed image on a different format signature. If the blanket cylinder 20 slows down relative to the plate cylinder 30, an image somewhat smaller than the circumference of the plate cylinder 30 will be printed on the web 2 for each revolution of the plate cylinder 30. Similarly, if the blanket cylinder 20 speeds up relative to the plate cylinder 30, an image somewhat larger than the circumference of the plate cylinder 30 will be printed on the web 2 for each revolution of the plate cylinder 30. This image will be distorted in the direction of web 2 travel. This distortion can be corrected by building an opposite distortion into the image on the plate cylinder 30 during pre-press operation. This is accomplished by creating either an elongated or shortened image on the plate in the direction of web 2 travel. Thus, when the image is shortened or elongated by the slowing down or speeding up of the blanket cylinder 20, this is compensated for by a corresponding elongation or shortening of the image on the plate in the direction of web travel, thereby resulting in a non-distorted image being printed on the web 2. For example, if the cutoff is changed by reducing speed 5% between the plate cylinder 30 and blanket cylinder 20, the plate would be made so that the image is increased or elongated by 5%, so that circles and dots would become ovals, and squares, rectangles, in the direction of web 2 movement. As a result, the speed reduction would be exactly compensated for by the image elongation, resulting in a correct image being printed.

The above technique of pre-conditioning a distortion into the plate cylinder can be used as a secondary method to achieve variable cutoff printing, and may be used, for example, for small cutoff changes, perhaps up to 5%. The primary method of achieving variable cutoff printing, however, is to change the diameter of the plate cylinder 30, that is, to remove an existing plate cylinder 30 and place a different plate cylinder 30 that has a different diameter into the printing unit 1.

Figure 6:
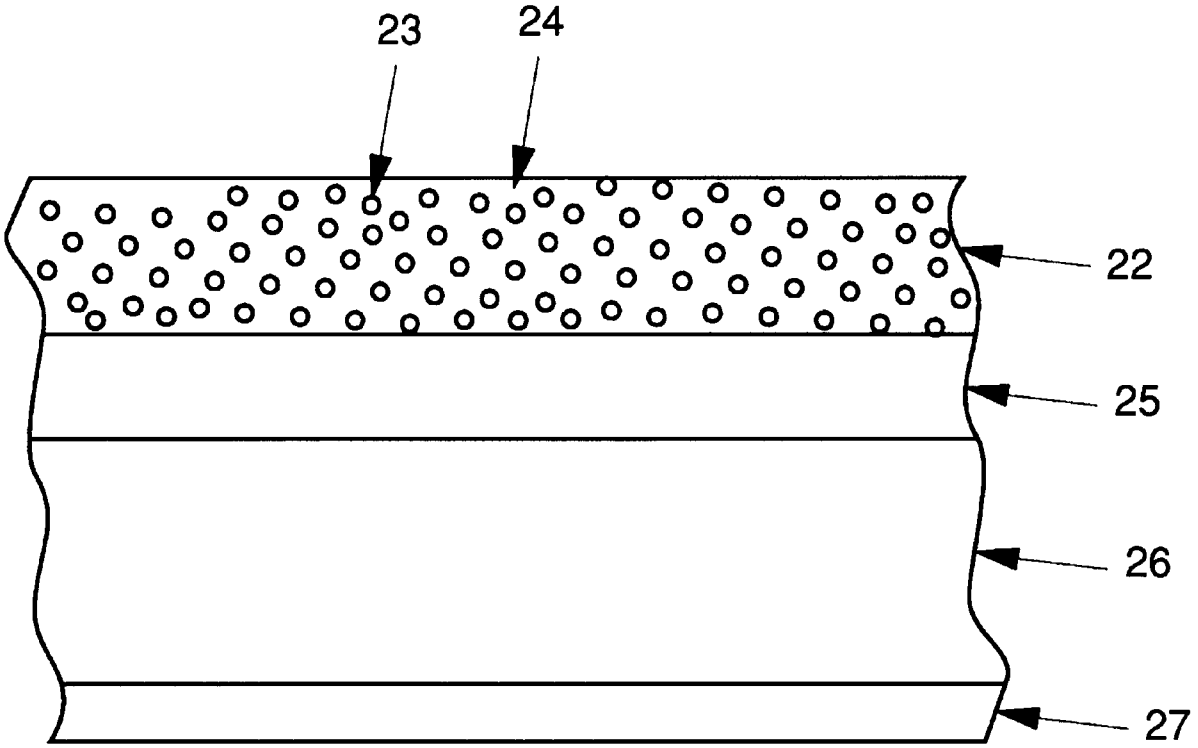
FIG. 6 shows a printing blanket according to an exemplary embodiment of the present invention.

Another aspect of the present invention relates to the elimination of latent images on the blanket cylinder 20. In offset printing, the latent image can be substantially eliminated—i.e., peeled or stripped off instead of split off—by using a surface material of low polarity surface energy—i.e., less than 4 dynes/cm, to create a total surface energy of less than 14 dynes/cm—such as PTFE or silicone in the blanket surface, and an appropriate water-based ink. FIG. 6 shows a portion of a blanket 21 that may be mounted on the blanket cylinder 20, such as, for example, a sleeve type blanket 21. The blanket 21 includes a surface layer 22 which has PTFE as a component. For example, the surface layer 22 of the blanket 21 may include a PTFE powder 23 dispersed throughout a rubber matrix 24, preferably rubber. The PTFE powder 23 may alternatively be replaced with, for example, silicone powder. The PTFE or silicone powder 23 preferably is greater than 50% by volume of the surface layer 22. Also, the PTFE powder or silicone powder is preferably in sizes in a range of, for example, 0.1 $\mu$m to 1.0 $\mu$m. The blanket 21 may also contain other layers below the surface layer 22, such as a compressible layer 25, a base rubber layer 26, and a sleeve layer 27, such as nickel or plastic. These additional layers are known in the art, as discussed for example, in U.S. Pat. Nos. 5,323,702 and 5,304,267 which are incorporated herein by reference. The sleeve layer 27 may, for example, slide over the outer circumference of the blanket cylinder. Alternatively, PTFE tape may be used on the surface of the blanket 21.

By using PTFE or silicone on the surface of the blanket 21 according to the present invention, the transfer of ink from the plate cylinder 30 to the blanket cylinder is adequate and the blanket-to-web transfer is nearly 100% complete, and therefore there is no latent image on the blanket 21 after it contacts the web 2. This means that it is no longer necessary to synchronize the position of the blanket cylinder 20 to the position of the plate cylinder 30 on every revolution. Different rotational speeds for differently sized plate cylinders 30 and blanket cylinders 20 are permissible as long as the surface speeds are appropriately matched to provide acceptable print quality. This allows for the customization of every sequential image by any direct-to-plate technology.

In the above description of the invention, those skilled in the art will perceive improvements, changes and modifications. Improvements, changes and modifications within the skill of the art are intended to be covered by the claims.

What is claimed is:

1. A device for variable cutoff printing, comprising:

a printing blanket;

a blanket cylinder rotatably mounted in a frame of the device, the printing blanket mounted on the blanket cylinder;

a printing plate;

an interchangeable plate cylinder rotatably mounted adjacent to the blanket cylinder, the printing plate mounted on the plate cylinder, the plate cylinder with the printing plate mounted thereon having a first diameter; and an inker mechanism attached to the frame, the inker mechanism including a inker form roller adjustably and rotatably mounted adjacent to the plate cylinder, the position of the inker form roller being adjustable so that the inker form roller may be placed in rolling contact with the printing plate, wherein the inker mechanism further comprises a rotatably mounted primary roller, and wherein the plate cylinder is movably mounted so that a distance from a center of rotation of the primary roller to a center of rotation of the plate cylinder is adjustable.

2. The device according to claim 1, wherein the blanket has a surface layer comprising PTFE.

3. The device according to claim 1, wherein the blanket has a surface layer comprising silicone.

4. The device according to claim 1, wherein the blanket has a surface layer comprising at least 50% PTFE powder in a rubber matrix.

5. The device according to claim 1, wherein the blanket has a continuous printing surface.

6. The device according to claim 5, wherein the continuous printing surface is an outer circumferential surface of a tubular printing blanket.

7. The device according to claim 1, wherein the interchangeable plate cylinder is removably mounted in the frame, the plate cylinder being interchangeable with a second plate cylinder having a second plate diameter different from the first plate diameter, and wherein the position of the inker form roller is adjustable so that the inker form roller may be placed in rolling contact with the second plate cylinder.

8. The device according to claim 1, wherein the inker form roller is mounted on an arm, and wherein the arm is hinged about the primary roller to allow adjustment the position of the inker form roller relative to the plate cylinder.

9. The device of claim 1, further comprising a source of water-based ink.

10. The device of claim 1, wherein the blanket has a surface layer of a material having a total surface energy of less than 14 dynes/cm.

11. A method of offset printing, comprising:

mounting a plate cylinder including a printing plate such that a circumferential surface of the printing plate is in rolling communication with a circumferential surface of a printing blanket mounted on a blanket cylinder;

providing an inker form roller;

adjusting a position of the inker form roller such that the inker form roller is in rolling communication with the circumferential surface of the printing plate;

rotating the inker form roller, the plate cylinder, and the blanket cylinder such that a surface speed of the inker form roller is substantially matched with a surface speed of the plate cylinder, and a surface speed of the blanket cylinder is different than the surface speed of the plate cylinder;

providing ink to the inker form roller;

transferring the ink to the surface of the printing plate wherein a distorted image is transferred to the surface of the printing plate;

transferring the ink to the surface of the blanket; and transferring ink from the blanket to a web of material wherein a non-distorted image is transferred from the blanket to the web of material.

12. The method of claim 11, including transferring a water-based ink.

13. A printing blanket for offset printing, the printing blanket comprising:

a cylindrical tubular base member;

an intermediate compressible layer; and a surface layer including a component selected from group consisting of PTFE and silicone, the surface layer including a continuous printing surface, the surface layer including a rubber matrix, and wherein the component is in the form of a powder mixed with the rubber matrix.

14. The printing blanket according to claim 13 wherein the component comprises greater than 50% by volume of the surface layer.

15. A device for variable cutoff printing, comprising:

a printing blanket;

a blanket cylinder rotatably mounted in a frame of the device, the printing blanket mounted on the blanket cylinder;

a printing plate;

an interchangeable plate cylinder rotatably mounted adjacent to the blanket cylinder, the printing plate mounted on the plate cylinder, the plate cylinder with the printing plate mounted thereon having a first diameter; and an inker mechanism attached to the frame, the inker mechanism including a inker form roller adjustably and rotatably mounted adjacent to the plate cylinder, the position of the inker form roller being adjustable so that the inker form roller may be placed in rolling contact with the printing plate, wherein the inker mechanism further comprises:

a rotatably mounted primary roller;

a distribution roller rotatably mounted adjacent to the primary roller;

a vibration roller rotatably mounted adjacent to the distribution roller and adjacent to the inker form roller;

wherein the distribution roller, vibration roller, and inker form roller are movably mounted relative to the primary roller.

16. A printing blanket for offset printing, the printing blanket comprising:

a cylindrical tubular base member;

an intermediate compressible layer; and a surface layer including a component selected from group consisting of PTFE and silicone, the surface layer including a continuous printing surface, wherein the component comprises particles having a size in a range of 0.1 $\mu$m to 1.0 $\mu$m.

* * * * *